US012806512B2

(12) United States Patent
Broers et al.

(10) Patent No.: US 12,806,512 B2
(45) Date of Patent: Nov. 24, 2026

(54) PROJECTION FEATURE FOR AMUSEMENT DEVICES

(71) Applicant: Helix Leisure Pte Ltd., Singapore (SG)

(72) Inventors: Frederik Johannes Broers, Singapore (SG); Timothy Syn Yong Zhong, Singapore (SG); Ian Kwan, Singapore (SG)

(73) Assignee: LAI Games Pte Ltd., Singapore (SG)

( * ) Notice: Subject to any disclaimer, the term of this patent is extended or adjusted under 35 U.S.C. 154(b) by 177 days.

(21) Appl. No.: 18/893,589

(22) Filed: Sep. 23, 2024

(65) Prior Publication Data

US 2025/0312690 A1 Oct. 9, 2025

Related U.S. Application Data

(60) Provisional application No. 63/573,815, filed on Apr. 3, 2024.

(51) Int. Cl.

| | |
|---|---|
| ***A63F 11/00*** | (2006.01) |
| ***A63F 9/02*** | (2006.01) |
| *A63F 9/24* | (2006.01) |

(52) U.S. Cl.

CPC ..... *A63F 11/0051* (2013.01); *A63F 9/0204* (2013.01); *A63F 9/0252* (2013.01); *A63F 9/0278* (2013.01); *A63F 9/24* (2013.01); *A63F 2009/2451* (2013.01); *A63F 2009/2463* (2013.01); *A63F 2011/0058* (2013.01); *A63F 2011/0072* (2013.01)

(58) Field of Classification Search

CPC ... A63F 11/0051; A63F 9/0204; A63F 9/0252

USPC ..... 273/317

See application file for complete search history.

(56) References Cited

U.S. PATENT DOCUMENTS

| | | | | |
|---|---|---|---|---|
| 4,054,287 | A * | 10/1977 | Goldfarb | A63F 7/00 273/127 D |
| 6,298,841 | B1 | 10/2001 | Cheng | |
| 9,739,585 | B2 | 8/2017 | Nugent, Jr. et al. | |
| 10,648,775 | B2 | 5/2020 | Sullivan | |
| 11,898,816 | B2 | 2/2024 | Chang | |
| 11,933,575 | B2 | 3/2024 | Song | |
| 2004/0087376 | A1 | 5/2004 | Yamaguchi | |
| 2010/0273130 | A1 * | 10/2010 | Chai | G09B 9/003 463/2 |
| 2023/0175809 | A1 | 6/2023 | Quek | |
| 2023/0258425 | A1 | 8/2023 | Chang | |

(Continued)

FOREIGN PATENT DOCUMENTS

| | | | |
|---|---|---|---|
| KR | 10-0957918 | 5/2010 | |
| WO | 2017/067747 | 4/2017 | |
| WO | WO-2025151151 A2 * | 7/2025 | F42B 12/40 |

*Primary Examiner* — Daniel A Hess

(74) *Attorney, Agent, or Firm* — Snell & Wilmer LLP

(57) ABSTRACT

An amusement game device is provided. The amusement game device includes a projectile launcher configured to launch a projectile, and a light-emitting device associated with the projectile launcher. The light-emitting device is configured to emit light for a first period of time towards the projectile at a time after the projectile has been launched by the projectile launcher. The amusement game may also include one or more projectors, such as for causing different target information to be displayed.

20 Claims, 2 Drawing Sheets

(56) References Cited

U.S. PATENT DOCUMENTS

2023/0260364 A1* 8/2023 Cook ..... G07F 17/3206
463/29

* cited by examiner

PROJECTION FEATURE FOR AMUSEMENT DEVICES

RELATED APPLICATION DATA

This application claims priority to U.S. Provisional Application Ser. No. 63/573,815, filed Apr. 3, 2024, and incorporates by reference said application as if set forth fully herein.

FIELD OF THE INVENTION

The present invention relates to amusement devices, and particularly those which are configured with projectile launchers.

BACKGROUND OF THE INVENTION

A variety of amusement devices are known. Many of these devices are configured to present shooting games, e.g., games in which a player fires a projectile launcher (such as a firearm) to launch one or more projectiles. Some amusement devices present the game as a video game, e.g., where the elements of the game are presented graphically on a video display.

However, for increased realism, some amusement devices utilize projectile launchers which launch physical projectiles. Such a game may present a variety of targets that the player attempts to hit with projectiles fired from their projectile launcher.

Even these amusement devices, however, suffer from drawbacks. First, the targets are generally static and don't change over time, which makes the game less interesting as it is played over and over by a player. Another issue is that it is often difficult for the player to see the projectiles or otherwise obtain feedback regarding the trajectories thereof, such to aid them in correcting their aim.

SUMMARY OF THE INVENTION

Aspects of the invention comprise amusement devices, amusement games, and features of amusement devices and games. One aspect of the invention comprises a projectile launcher having an associated light-emitting device for generating a projectile tracer effect, and amusement devices and games having such a projectile launcher. Another aspect of the invention comprises an amusement device which includes one or more projectors or projection devices which are configured to project game information onto portions of the amusement device, such as one or more targets.

In one embodiment, the invention comprises an amusement game device, comprising a projectile launcher configured to launch a projectile, and a light-emitting device associated with the projectile launcher. The light-emitting device is configured to emit light for a first period of time towards the projectile at a time after the projectile has been launched by the projectile launcher. In one embodiment, the projectile is a white colored sphere.

In another embodiment, an amusement game device comprises a housing defining a shooting gallery in an interior thereof, the shooting gallery comprising at least one target and at least one secondary surface; a projectile launcher coupled to the housing and configured to launch a projectile within the interior of the housing; and at least one projection device associated with the housing, and configured to project information onto the target and the secondary surface.

Further objects, features, and advantages of the present invention over the prior art will become apparent from the detailed description of the drawings which follows, when considered with the attached figures.

DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Aspects of the invention comprise amusement game devices, amusement games, and features of amusement devices and games. In one embodiment, the invention comprises an amusement device with at least one projection device, such as for projecting graphics onto one or more targets or other locations of the amusement device. Another aspect of the invention comprise a projectile illumination feature for such an amusement device and game.

As employed herein, the term "coupled" shall mean connected together either directly or via one or more intermediate parts or components.

As employed herein, the phrase "associated with" shall include being "coupled to".

As employed herein, the term "number" shall mean one or an integer greater than one (i.e., a plurality).

Figure 1:
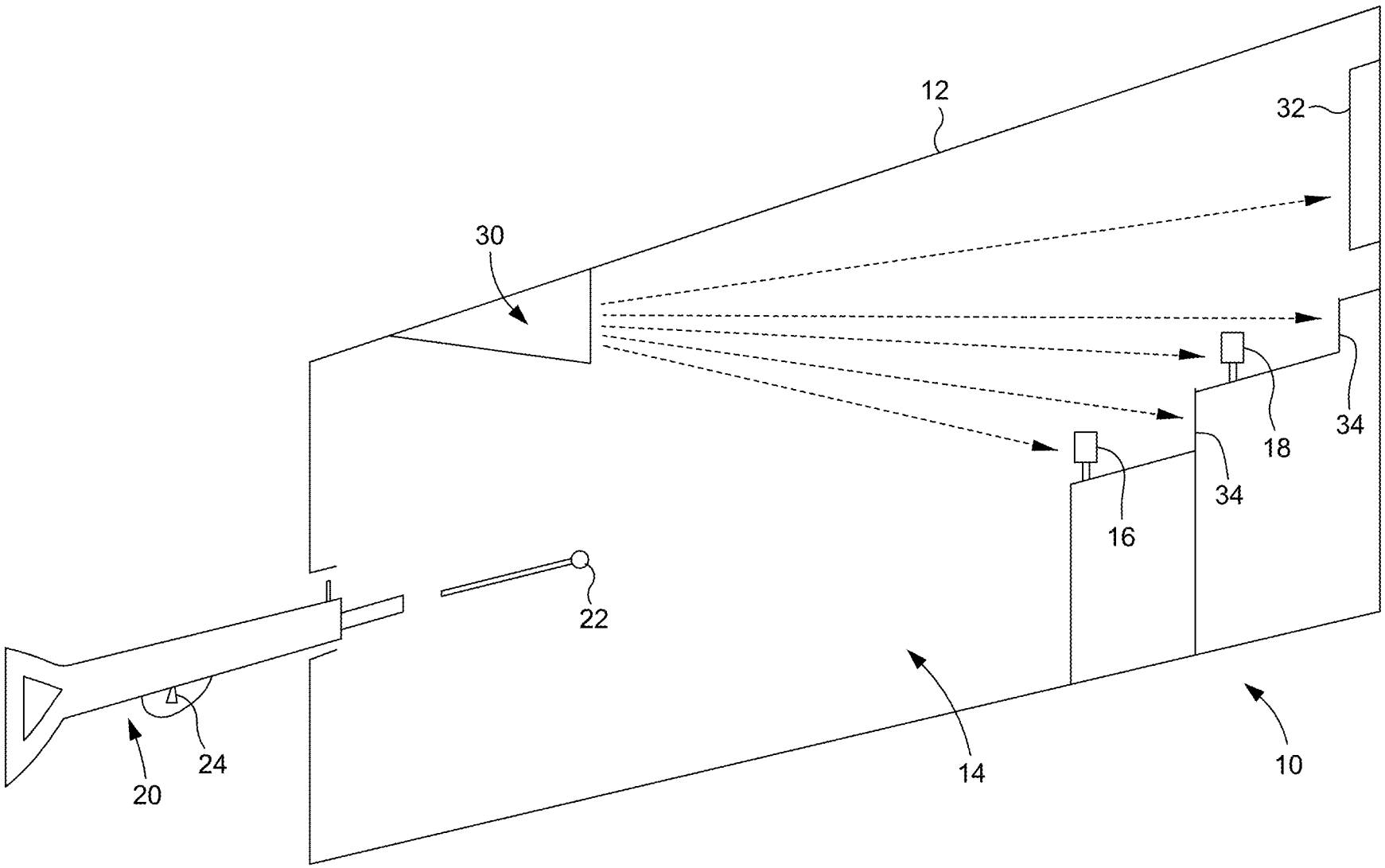
FIG. 1 illustrates a simplified view of one example of an amusement device in accordance with the invention.

FIG. 1 illustrates aspects of the present invention. As illustrated, an amusement game device 10 includes a housing 12 which defines an interior 14. The housing 12 may include a front wall 12-1, a rear wall 12-2 located opposite the front wall 12-1, a bottom wall 12-3 extending from the front wall 12-1 to the rear wall 12-2, and a top wall 12-4 located opposite the bottom wall 12-3 and also extending from the front wall 12-1 to the rear wall 12-2. The interior 14 may be configured as a shooting gallery which includes one or more targets 16, 18.

In one example, the targets may be associated with (such as supported by) different structures, such as to be located at different locations (including elevations). In the illustrated example, the interior 14 includes a first structure 14-1 and a second structure 14-2, each of which may protrude into the interior 14 from, for example, the bottom wall 12-3. As shown in FIG. 1, the first structure 14-1 may extend from the second structure 14-2. It will also be appreciated that multiple structures within a housing may be spaced from each other, without departing from the scope of the disclosed concept. For example, there may be less than two structures or more than two (such as three or four, so that three or four rows or levels of targets may be provided), the structures may be contiguous or non-contiguous, and may have a variety of shapes and locations. The first and second targets 16, 18 may each be coupled to or extending from a corresponding one of the first structure 14-1 and the second structure 14-2, and also may extend directly from an interior surface of the housing 12 itself. Furthermore, secondary surfaces 34 may each be provided as part of a corresponding one of the first structure 14-1 and the second structure 14-2.

In one embodiment, one or more players may be located exterior to the front wall 12-1 and the targets 16, 18 may be located at or towards the rear wall 12-2. The targets 16, 18 may have different shapes and sizes and may be located at different locations, including different elevations and distances from the front of the device. For example, as shown, the first structure 14-1 may have a first height, and the second structure 14-2 may have a second height greater than the first height of the first structure 14-1. In one embodiment, the targets 16, 18 may be configured to register being hit by a projectile, such as by one or more sensors and/or by moving from a first (such as upright) position to a second (such as collapsed/folded) position.

In one embodiment, the amusement game device 10 includes at least one projectile launcher 20 coupled to the housing 12 (e.g., via a cord, cable, or directly connected thereto) and configured to launch a projectile 22 within the interior 14 of the housing 12. When connected to the housing 12, the projectile launcher 20 may be configured to swivel and or move with respect to the housing 12, such as a via a pivoting and/or swivel mount. The projectile launcher 20 may include a launcher, such as an air propulsion system, a spring-biased launch mechanism or other launcher which is configured to eject the projectile 22 therefrom, such as in response to a player providing input thereto, such as via a trigger 24.

In one embodiment, the projectile 22 comprises a ball, such as in the form of a spherical plastic pellet. The projectile 22 is preferably not only spherical in shape, but is also preferably white in color, for the reasons noted below. In one embodiment, the projectile 22 may be molded from a bright white plastic. As noted below, such a configuration has a number of advantages relating to the generation of a projectile tracer effect. However, such as effect might still be generated using projectiles having other configurations, including other shapes and colors (or other surface features).

The amusement game device 10 may include a number of other features, such as a game controller (e.g., a game processor 60 (FIG. 1) having an associated memory 62 (FIG. 1) which stores machine readable code or "software" in the memory for execution by the processor) which is preferably electrically connected to the projectile launcher 20, at least one projection device (e.g., without limitation, video projector 30), a monetary value accepting device 70 (shown in simplified form in FIG. 1), and a projectile capture and feed mechanism (not shown for ease of illustration). Additional aspects of these features are described below.

As one aspect of the invention, the amusement game device 10 further includes the video projector 30 associated with the housing 12, and configured to project information onto the targets 16, 18 and at least one secondary surface 34. The video projector 30 is preferably configured to cause graphical information to be displayed at one or more locations of the amusement device 10 (e.g., the targets 16, 18 and the secondary surfaces 34, and a rear panel 32 associated with (e.g., coupled to) the rear wall 12-2 of the housing 12 and provided as part of the amusement device 10). In one example, graphics may be projected onto the surfaces 34 behind the targets 16, 18, such as generally vertically extending panels located behind them. The projector 30 might comprise, for example, a laser, DLP, LED, LCos or other projector. In some embodiments, two or more projectors may be utilized, such as to cause information to be displayed in different locations of the amusement game device 10

The particular graphics which are projected, and the timing thereof, may vary, such as based upon an output of the game processor 60. In one embodiment, the video projector 30 may comprise a single projector which is capable of projecting different information to different locations, or a plurality of different projectors. In one embodiment, the targets 16, 18 may define projection surfaces, such as generally flat front surfaces on which the projected information is displayed. In some embodiments, the front faces of the targets 16, 18, the surfaces 34 and/or rear panel 32 may be generally black in color.

As one example, the video projector 30 may be configured to project and cause game information to be displayed on the rear panel 32. Target information may be projected and displayed on the targets 16, 18. Target score information may be displayed on the surfaces 34 behind the targets 16, 18, such as in response to a player hitting one of the targets with a projectile. Of course, the game information, target information and score or other information may change during the game, for different games, etc. Furthermore, the graphics or other information which is projected by the video projector 30 may vary, such as comprising images, words, numbers, etc.

In one example, at a first point in time, the video projector 30 is configured to project first information onto the targets 16, 18 and second information onto the secondary surfaces 34, wherein the first information may be different than the second information. Furthermore, the second information may be configured to be projected onto the secondary surfaces responsive to the projectile hitting one of the targets 16, 18. Moreover, the video projector 30, or another projection device, is preferably configured to change at least one of the first information and the second information responsive to a full game of the amusement device 10 being played by a player. It will also be appreciated that the video projector 30 may be configured to change at least one of the first information and the second information during a game of the amusement device 10.

The information which is displayed by the video projector 30 may be stored in one or more data storage devices, such as a memory associated with the video projector 30 or the game processor 60. In some embodiments, the video projector 30 may include a projector processor and associated memory, where the processor of the video projector 30 is configured to receive signals (such as instructions/prompts) from the main game processor 60, such as to display certain information at certain times.

Another aspect of the invention comprises a projectile illumination feature. In one embodiment, this feature comprises a light emitting device 40 (see FIG. 2) which is configured to, at one or more times, emit visible light at a launched projectile. In a preferred embodiment, the light emitting device 40 is associated with the projectile launcher 20 (FIG. 1), and comprises a laser associated with the projectile launcher 20. The laser may be configured to emit light at one or more frequencies (and thus colors), such as the preferred color of red.

Figure 2:
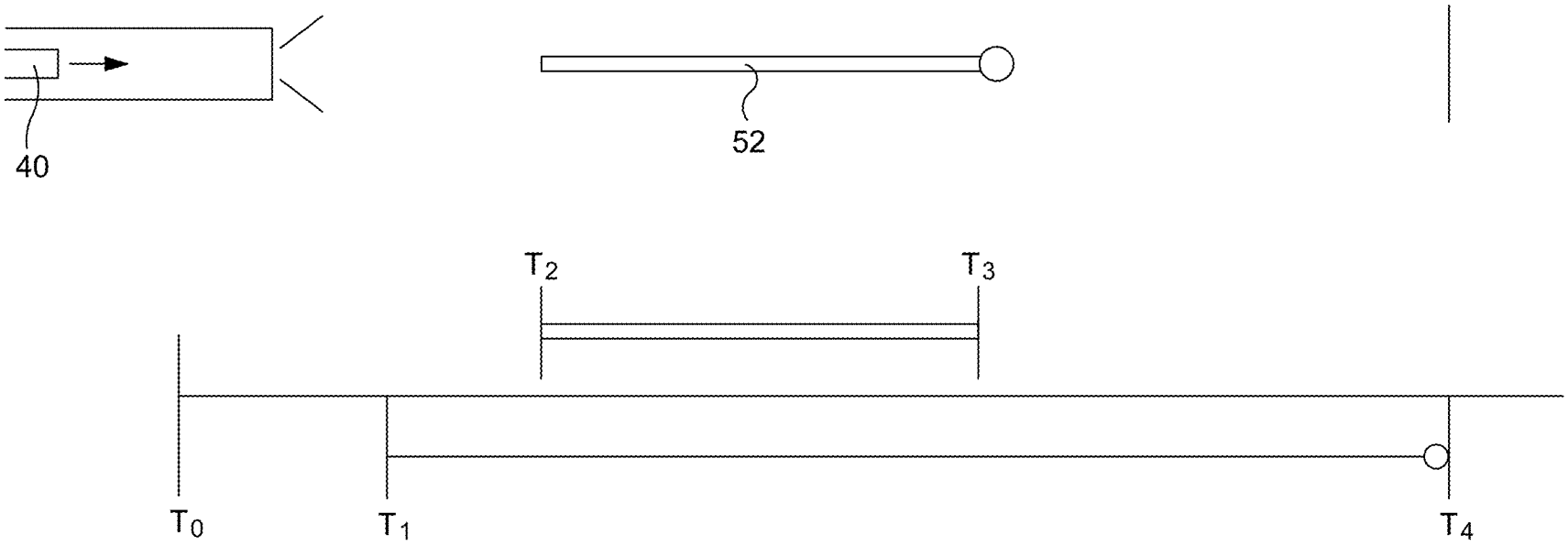
FIG. 2 illustrates a simplified view of aspects of a projectile illumination feature of the invention.

As illustrated in FIG. 2, the light-emitting device 40 is preferably configured to emit light at a particular time, and for a particular time period/duration, so as to cause the player to see a light beam which appears to be coincident with a portion of the path of a launched projectile 22.

In particular, a game may start at a time T0. At a time T1, a player may cause a projectile 22 to be launched. Preferably, at a time T2 after time T1, which time T2 corresponds to a time at which the projectile has left the projectile launcher 20, the light emitting device 40 is activated.

The light emitting device 40 preferably remains activated until a time T3. This time T3 is preferably before the projectile 22 reaches or impacts a target 16, 18 or other portion of the housing 12. Accordingly, it can be said that the light-emitting device 40 is preferably configured to emit light for a first period of time (e.g., T3 minus T2, FIG. 2) towards the projectile 22 at a time after the projectile 22 has been launched by the projectile launcher 20. It will also be appreciated that the projectile launcher 20 may be configured to launch the projectile 22 for a second period of time (e.g., T4 minus T1, or, until the projectile 22 strikes a wall of the housing 12, one of the targets 16, 18, rear surfaces 34, or other structure), and the first period of time (e.g., T3 minus T2) is preferably less than said second period of time.

Furthermore, and continuing to refer to FIG. 2, the projectile launcher 20 (partially shown in FIG. 2) preferably has a barrel 21 out of which the projectile 22 is launched. As shown, the light-emitting device 40 is preferably located within the barrel 21, and optionally spaced a distance inside the barrel 21 from a distal portion thereof. In another example the light-emitting device is disposed on an exterior of the projectile launcher 20. In yet a further example, the light-emitting device 40 may be located on or coupled to an interior of the housing 12 (FIG. 1) and configured to swivel responsive to swiveling of the projectile launcher 20.

As illustrated in FIGS. 1 and 2, the illumination of the projectile 22 with the light emitting device 40 for a period of time (from time T2 to T3), and thus over a distance of travel of the projectile 22, creates a visible light beam 52 caused by the reflection of the emitted light off of the projectile 22 during that time duration. This light beam 52 effectively causes the projectile 22 to appear as a "tracer" round, where the light beam 52 allows the player to see the path of the projectile 22 from the projectile launcher 20 towards the targets 16, 18. In one embodiment, this effect is facilitated by use of a spherical, white projectile, as such effectively reflects back a larger portion of the emitted light that hits it, and reflects that light in a number of directions due to the spherical surface thereof. Thus, when the emitted light hits the projectile 22 at a particular point in time, a generally circular area of light becomes visible. As the projectile moves, this "disc" of illumination moves, thus creating the appearance of a light beam.

In general, the game processor 60 may be configured to initiate presentation of a game in response to input by a player of monetary value to the monetary value accepting device 70. The monetary value accepting device 70 may be associated with the housing 12. In response to the input by the player, the game processor 60 may cause the video projector 30 to project game information, such as on the rear panel 32. The game processor 60 may then also cause the video projector 30 to project other information, such as on the targets 16, 18 and the surfaces 34 there behind. That is, the game processor 60 is preferably configured to cause the video projector to project game information onto the rear panel 32 responsive to input of a monetary value to the monetary value accepting device 70 by a player. Of course, the game processor 60 might also cause one or more audio devices (such as speakers) to emit sound, such as game instructions, music or the like.

Further, in one embodiment, the projectile launcher 20 is, except during game play, disabled from use. This may, for example, comprise disabling of the trigger 24, or at least inputs to the trigger. When the game is initiated, the trigger 24 may be activated, such as by allowing the projectile launcher 20 or the game processor 60 to register those inputs and generate inputs or signals which cause the projectile launcher 20 launch one or more projectiles 22.

In some embodiments, the game processor 60 may, in response to a signal from the projectile launcher 20 of the launching of a projectile, trigger the light emitting device 40. In other embodiments, projectile launcher 20 may trigger the light emitting device 40 (in some embodiments, for example, the projectile launcher 20 may include its own processor which communicates with the game processor 60, where the processor of the projectile launcher 20 receives trigger inputs and, in response thereto, outputs a signal to a launching mechanism to effect launching of a projectile 22 and activation of the light emitting device 40) thus causing the creation of the visible light beam 52. As the player hits targets with the projectiles 16, 18, hitting of the targets may be registered (such as with sensors associated with the targets), score information may be displayed (such as a score for each target hit) and/or a game score may be accrued.

Launched projectiles may be collected by the collection mechanism and transported back to the projector launcher 20 to be relaunched.

In one embodiment, the projectile launcher 20 (such as the trigger 40 thereof) may only be enabled for a period of time, or for one or more periods of time, during the game (the game might have, for example, a single round, multiple rounds, etc.). In one embodiment, the object of the invention may be to hit as many targets as possible during one or more time periods.

At the end of the game, the game processor 60 may register an outcome, such as a game score. The game processor 60 might, for example, cause a dispensing device to dispense a prize, tokens, printed prize tickets, etc., as is known in the amusement industry.

It will be appreciated that the amusement device may be configured to present a 1-player game or a multi-player (such as 2-player) game. In such instances, the amusement device 10 may include more than one projectile launcher 20 and the players might be permitted to shoot projectiles 22 at the targets 16, 18 at the same time or at different times (such as in alternating rounds).

It will be appreciated that the housing 12 of the amusement device 10 may have a variety of configurations, including shapes. In one embodiment, at least portions of the front and sides of the housing may be generally transparent, thus permitting the player(s) and/or other viewers, to see the shooting gallery and the launched projectiles.

It will be appreciated that the features of the invention may be used separately or in combination. Further, the features of the invention might be utilized with other amusement devices, or devices other than amusement devices. For example, features of the invention might be utilized with wagering type games or in other environments.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. An amusement game device comprising:

a projectile launcher configured to launch a projectile, said projectile launcher having a barrel from which said projectile is launched; and a light-emitting device associated with said projectile launcher, said light-emitting device being configured to emit light for a first period of time towards said projectile at a time after said projectile has exited said barrel of said projectile launcher.

2. The amusement game device according to claim 1, wherein said light-emitting device is disposed within said barrel and projects light from said barrel through a space outside of said barrel to a position of said projectile.

3. The amusement game device according to claim 1, wherein said light-emitting device comprises a laser associated with said projectile launcher.

4. The amusement game device according to claim 1, further comprising a housing defining a shooting gallery in an interior thereof, wherein said projectile launcher is coupled to said housing and configured to launch said projectile within said interior of said housing.

5. The amusement game device according to claim 1, wherein said projectile travels for a second period of time after exiting said barrel until said projectile impacts an object, said second period of time having a start and an end, and wherein said first period of time starts after said start of said second period of time and is less than said second period of time.

6. An amusement game device comprising:

a housing defining a shooting gallery in an interior thereof, said shooting gallery comprising two or more distinct targets which are configured to register being impacted by a projectile and at least one secondary surface;

a projectile launcher coupled to said housing and configured to launch a projectile within the interior of said housing; and at least one projection device associated with said housing, and configured to project first information onto said two or more distinct targets and second information which differs from said first information onto said at least one secondary surface.

7. The amusement game device according to claim 6, wherein said at least one projection device comprises at least one video projector configured to project graphics onto said two or more distinct targets and said at least one secondary surface.

8. The amusement game device according to claim 6, wherein a front face of each of said two or more distinct targets and said at least one secondary surface is generally black in color.

9. The amusement game device according to claim 6, wherein, at a first point in time, said at least one projection device is configured to project first information onto said two or more distinct targets and second information onto said at least one secondary surface, said first information being different than said second information.

10. The amusement game device according to claim 9, wherein said second information is configured to be projected onto said at least one secondary surface responsive to said projectile hitting one of said two or more distinct targets.

11. The amusement game device according to claim 9, wherein said at least one projection device is configured to change at least one of said first information and said second information responsive to a full game of said amusement game device being played by a player.

12. The amusement game device according to claim 9, wherein said at least one projection device is configured to change at least one of said first information and said second information during a game of said amusement game device.

13. The amusement game device according to claim 6, further comprising a rear panel associated with a rear wall of the housing, and wherein said at least one projection device is further configured to project information onto said rear panel and wherein said two or more distinct targets are positioned forwardly from said rear panel.

14. The amusement game device according to claim 13, further comprising a monetary value accepting device and a game controller, wherein said monetary value accepting device is associated with said housing, wherein said game controller is electrically connected to said at least one projection device, and wherein said game controller is configured to cause said at least one projection device to project game information onto said rear panel responsive to input of a monetary value to said monetary value accepting device by a player.

15. The amusement game device according to claim 6, wherein said two or more distinct targets comprise a first target and a second target, said first target located at a first elevation and positioned forwardly of a first secondary surface and said second target located at a second elevation and positioned forwardly of a second secondary surface.

16. The amusement game device according to claim 6, wherein said projectile launcher has a barrel from which said projectile is launched, and further comprising a light-emitting device associated with said projectile launcher, said light-emitting device being configured to emit light for a first period of time towards said projectile at a time after said projectile exited said barrel of said projectile launcher.

17. The amusement game device according to claim 16, wherein said light-emitting device is disposed within said barrel.

18. The amusement game device according to claim 16, wherein said light-emitting device comprises a laser associated with said projectile launcher.

19. The amusement game device according to claim 16, further comprising a housing defining a shooting gallery in an interior thereof, wherein said projectile launcher is coupled to said housing and configured to launch said projectile within said interior of said housing.

20. The amusement game device according to claim 16, wherein said projectile launcher is configured to launch said projectile for a second period of time, and wherein said first period of time is less than said second period of time.

* * * * *